United States Patent [19]

Mintz

[11] Patent Number: 4,745,770

[45] Date of Patent: May 24, 1988

[54] HEATER/COOLER UNIT

[75] Inventor: Alvin Mintz, Pepper Pike, Ohio

[73] Assignee: Shaker Tinning & Heating Co., Cleveland, Ohio

[21] Appl. No.: 39,971

[22] Filed: Apr. 17, 1987

Related U.S. Application Data

[63] Continuation-in-part of Ser. No. 931,137, Nov. 17, 1986, Pat. No. 4,720,983.

[51] Int. Cl.[4] ..... F25D 23/12

[52] U.S. Cl. ..... 62/263; 62/237; 62/324.1; 62/448

[58] Field of Search ..... 62/263, 262, 259.1, 62/298, 237, 448, 324.1

[56] References Cited

U.S. PATENT DOCUMENTS

| | | | |
|---|---|---|---|
| 2,116,974 | 5/1938 | Keighley | 62/262 X |
| 2,702,175 | 2/1955 | Hanin | 62/262 X |
| 3,208,236 | 9/1965 | Frigerio | 62/262 |
| 3,213,636 | 10/1965 | MacLeod | 62/262 |
| 3,740,964 | 6/1973 | Herweg | 62/262 |
| 3,831,395 | 8/1974 | Levy | 62/263 |
| 3,938,348 | 2/1976 | Rickert | 62/262 X |

*Primary Examiner*—Lloyd L. King

*Attorney, Agent, or Firm*—Wayne D. Porter, Jr.

[57] ABSTRACT

A heater/cooler unit specially adapted for motels, hotels, hospitals and like structures enables adjacent rooms to be cooled or heated by using certain commonly shared components. An evaporator is disposed in each of two adjacent rooms. The evaporators are connected to a common compressor and condenser disposed outside the rooms. Appropriate control mechanisms are provided to enable the evaporators to operate independently. The components are disposed in a housing which forms a portion of the exterior wall of the structure and a portion of the common wall of the rooms. Certain of the components can be placed atop a cart which can be wheeled into and out of the housing so as to facilitate installation and servicing of the unit. Electrical strip heaters can be added to the evaporators to provide a heating capability. An alternative embodiment employs interior and exterior heat exchangers operated as heat pumps.

5 Claims, 4 Drawing Sheets

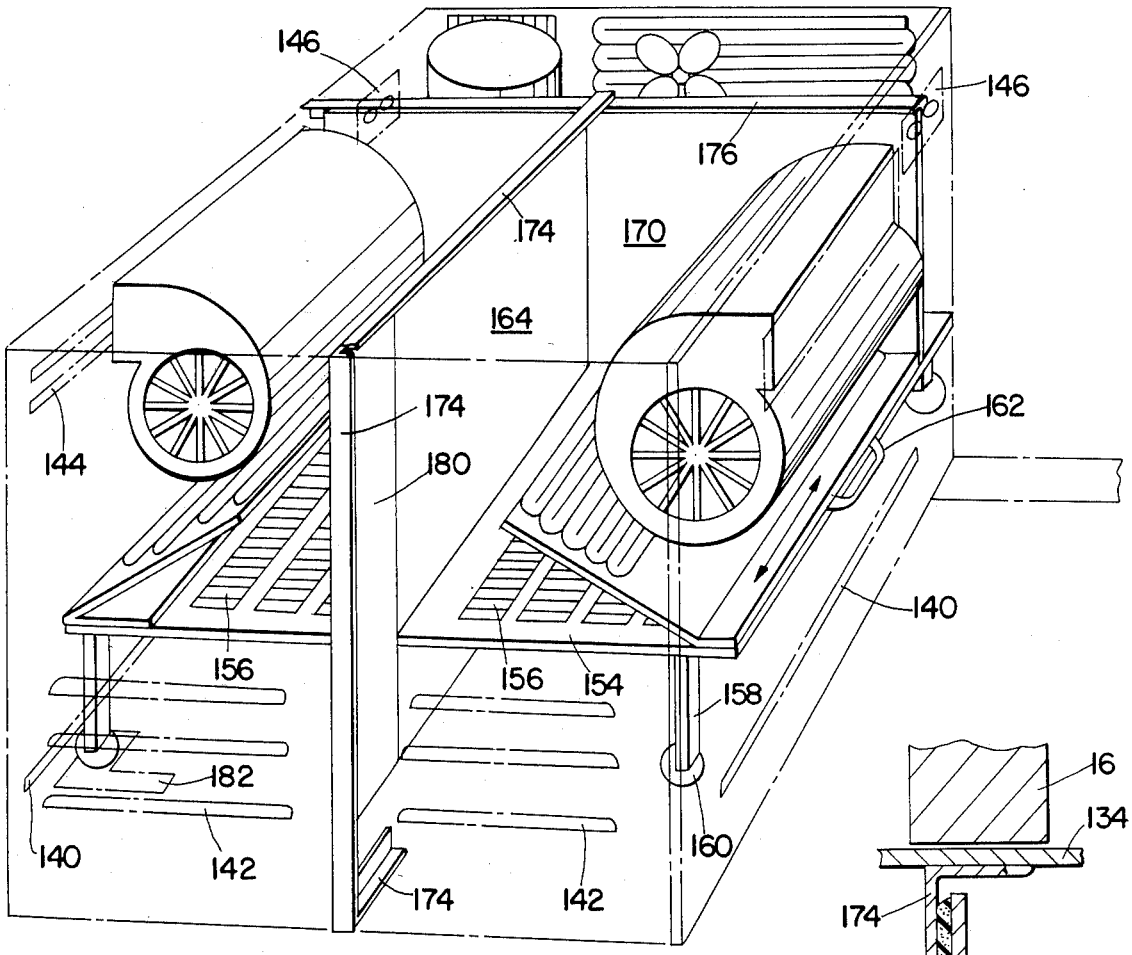
Fig. 6
Fig. 7A
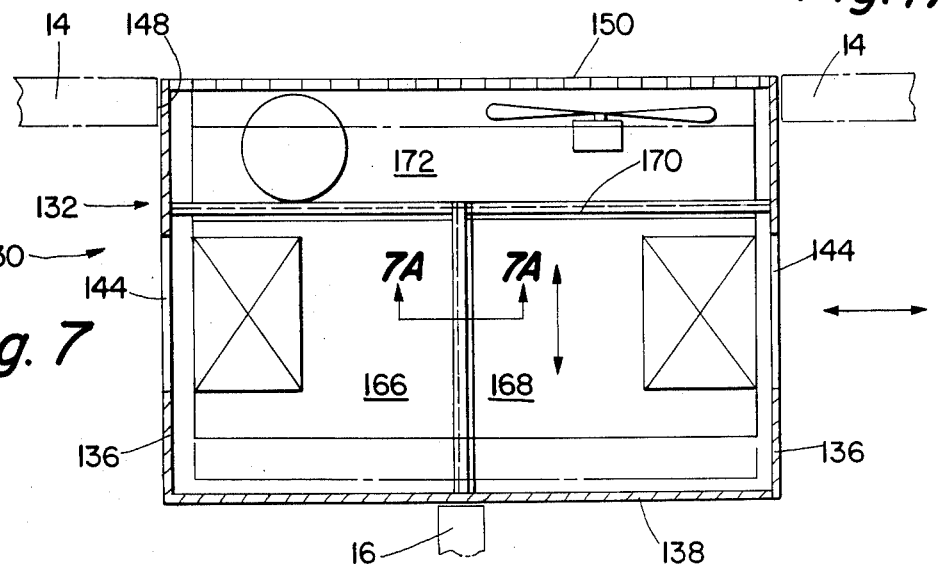
Fig. 7

HEATER/COOLER UNIT

BACKGROUND OF THE INVENTION

1. Cross-Reference to Related Application

The present application is a continuation-in-part of application Ser. No. 931,137, filed Nov. 17, 1986 by Alvin Mintz, now U.S. Pat. No. 4,720,983.

2. Field of the Invention

The invention relates to heating and cooling devices and, more particularly, to apparatus suitable for cooling and heating adjacent rooms in such structures as hotels, motels, hospitals, and the like.

3. Description of the Prior Art

In many buildings such as apartments, hotels, motels, hospitals, office buildings, and so forth, it is desirable to provide separate heating and cooling systems for individual rooms. A variety of units presently are commercially available that can be installed in each room, usually on an exterior wall, to provide cooling only, cooling plus heating with electric heat, or cooling plus heating with a heat pump. Typical commercially available heating/cooling units are marketed by the General Electric Company, Louisville, Ky. 40225, under the trademark ZONELINE.

Although commercially available heater/cooler units such as the ZONELINE unit function adequately, a problem not addressed by these units is the expense associated with providing heating and cooling capabilities for individual rooms. Current practice with heater/-cooler units is to install one unit in each room having an exterior wall. By definition, such an arrangement requires that various components of these units such as compressors and condensers be provided for each room. Desirably, a heater/cooler unit would provide only such components in each room as are needed to carry out the heating or cooling requirements for that room, with the remainder of the components being shared among rooms as much as possible.

Various techniques are known for heating or cooling different zones by means of heating or cooling apparatus located at a remote location. See, for example, U.S. Pat. Nos. 4,124,998; 4,368,621; 4,530,395; and 4,549,601. These prior art techniques have certain drawbacks such as undue expense, complexity, and difficulty of operation that limit their effectiveness in heating or cooling individual rooms in buildings such as hotels, motels, and the like.

SUMMARY OF THE INVENTION

The present invention addresses the foregoing and other problems of the prior art and provides a new and improved heating and cooling unit. The invention provides a method and apparatus for cooling and heating two or more adjacent rooms from the same unit without a mixing of the air between the rooms and with individual control of cooling and heating using a common condenser or heat exchanger. In its most basic form, the present invention provides only a cooling capability. The apparatus employs a first evaporator in one room, a second evaporator in an adjacent room, a condenser in fluid communication with both the first and second evaporators, a compressor in fluid communication with the condenser and with a return side of the first and second evaporators, and a control means for controlling fluid flow through each evaporator, the control means permitting fluid flow through the first evaporator to be controlled independently of fluid flow through the second evaporator.

In the preferred embodiment, the foregoing components are disposed within a housing which forms a portion of the exterior wall of the structure and a portion of the common interior wall of the rooms. By this arrangement, only one opening in the exterior wall is needed to permit cooling of two rooms while, at the same time, the cooling requirements for the two rooms can be determined independently by the occupants of the rooms. Use of the invention cuts in half a large number of the components commonly used with cooling units, and it also cuts in half the number of exterior openings required to be made in the walls of the building. As a consequence, significant cost savings can be realized, particularly in the case of buildings such as hotels and apartment buildings having many rooms.

If desired, a heating capability can be included by the addition of electric strip heaters or other known types of heaters disposed adjacent each of the evaporators. Heating also can be provided by operating the unit as a heat pump. In this embodiment of the invention, the evaporators and the condenser are operated as heat exchangers with a separate condenser/heat exchanger being provided for each of the evaporator/heat exchangers. Each heat exchanger pair is provided with its own compressor, thermostatically controlled change-over valve, and parallel connecting conduits such that the heat exchanger disposed in each room can be operated either in an air conditioning mode or in a heating mode. Savings can be realized by disposing all of the components in a common housing, as well as by disposing the two condenser/heat exchangers adjacent each other and cooling them with a common fan or a common source of water.

An alternative embodiment of the invention employs a modified housing construction and a cart atop which certain of the components can be placed. In this alternative embodiment of the invention, the cart enables the heater/cooler unit to be removed and replaced expeditiously. The cart includes walls which interact with sealing members disposed within the housing to create separate compartments within which the various components of the heater/cooler unit are disposed.

The foregoing features and advantages, as well as a more complete understanding of the invention, can be had by reviewing the accompanying specification and claims, together with the drawings.

DESCRIPTION OF THE DRAWINGS

FIG. 6 is a view similar to FIG. 1 showing an alternative embodiment of the invention;

FIG. 7 is a schematic plan view of the unit of FIG. 6;

FIG. 7A is an enlarged view of a portion of the unit of FIG. 6 taken along a plane indicated by line 7A—7A in FIG. 7;

DESCRIPTION OF THE PREFERRED EMBODIMENT

Figure 1:
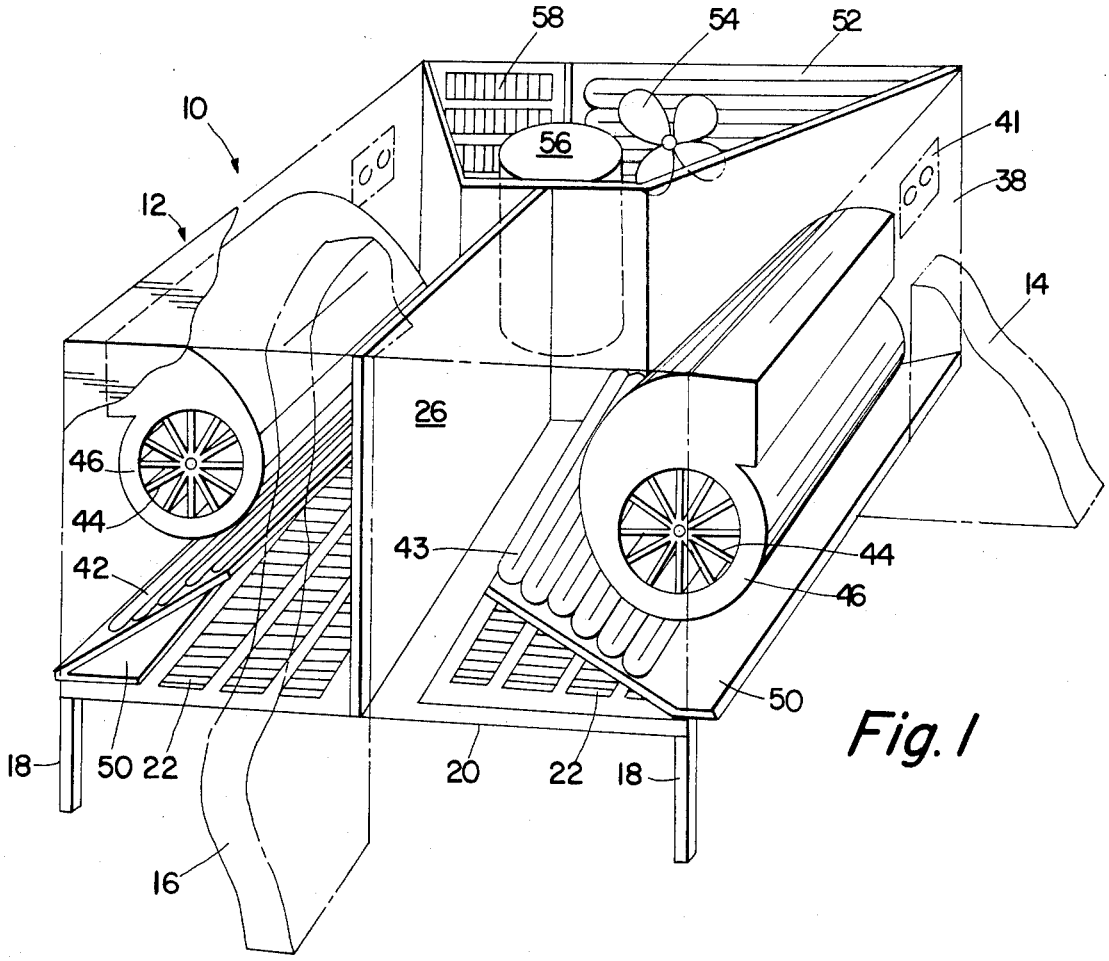
FIG. 1 is a perspective, schematic view of a heater/-cooler unit according to the invention as it might be installed in a hotel, motel, or like structure.
Figure 2:
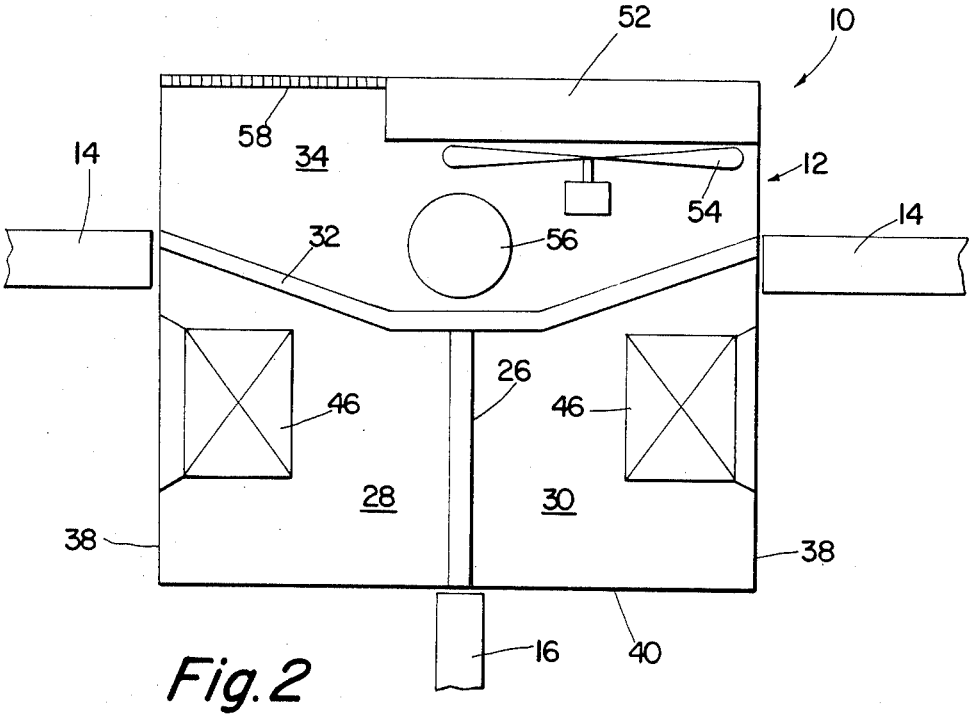
FIG. 2 is a schematic plan view of the unit of FIG. 1.
Figure 3:
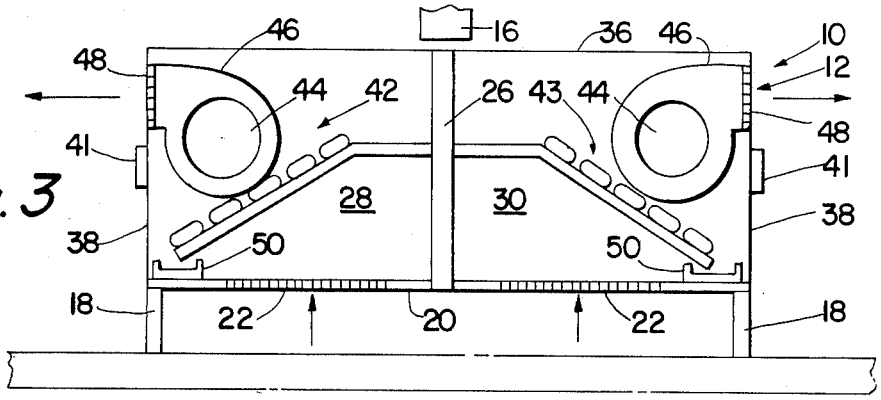
FIG. 3 is a schematic end view of the unit of FIG. 1.

Referring particularly to FIGS. 1–3, air conditioning apparatus is indicated generally by the reference numeral 10. As used herein, such terms as "unit," "air conditioning apparatus," "heater/cooler unit," and so forth are used interchangeably for purposes of convenience. It will be understood that the cooling and heating characteristics of a device produced according to the invention will depend upon the features selected by the purchaser.

The unit 10 includes a cubic housing 12 within which the various components of the invention are disposed. The housing 12 extends through an opening formed in an exterior wall 14 of the building, and the housing 12 straddles an opening formed in a common interior wall 16 dividing two adjacent rooms. The housing 12 is provided with legs 18 that both support the housing 12 and space the bottom 20 of the housing 12 above the floor such that air can freely enter the housing 12 through louvered openings 22.

The housing 12 includes a vertically extending interior wall 26 which divides the housing into compartments 28, 30. The compartment 28 is disposed in one room, while the compartment 30 is disposed in the other room. The housing 12 also includes a vertical, laterally extending interior wall 32 which defines a third compartment 34. The wall 32 is positioned relative to the exterior wall 14 such that the compartment 34 extends outside of the building or at least is exposed to the atmosphere outside the building. The interior portions of the housing 12 include a smooth upper surface 36, sidewalls 38, and end walls 40. Control panels 41 are disposed on the sidewalls 38, one control panel 41 being provided for each room. The size and shape of the components defining the housing 12 enable the housing 12 to be utilized as a desk or as a support for such items as lamps, televisions, radios, books, and the like.

A first evaporator 42 is disposed in the compartment 28 and a second evaporator 43 is disposed in the compartment 30. A fan 44 is disposed adjacent each of the evaporators 42, 43. Each fan 44 is disposed within a housing 46 discharging through louvered openings 48 in each of the walls 38. Drip pans 50 are disposed beneath the evaporators 42, 43 to collect condensate when the evaporators 42, 43 are operating in an air conditioning mode. As will be apparent from an examination of FIGS. 1 and 3, upon activation of the fans 44, air will be drawn upwardly through the openings 22 in the bottom wall 20, ducted through the coils of the evaporators 42, 43, and discharged back into the rooms through the openings 48.

A condenser 52, fan 54, and compressor 56 are disposed in the compartment 34. Openings 58 in the compartment 34 enable air to be drawn into the compartment 34 where it can be forced under pressure through the coils of the condenser 52 and back into the atmosphere.

Figure 4:
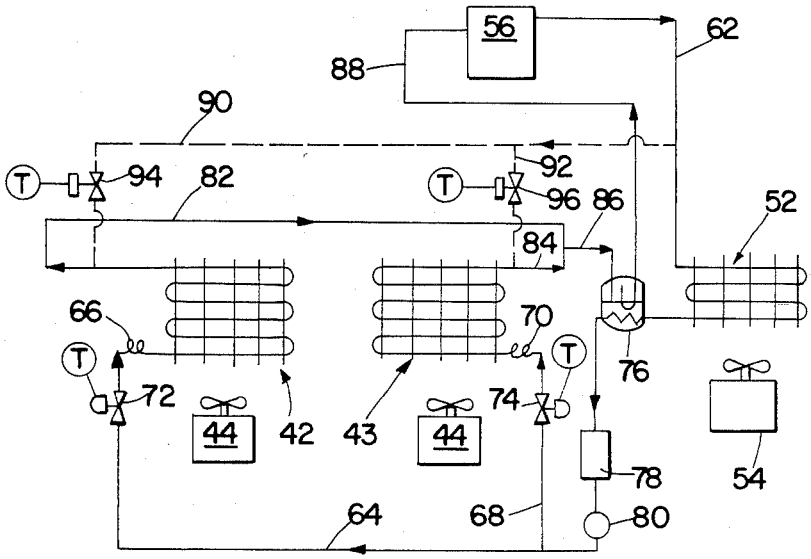
FIG. 4 is a piping diagram for one embodiment of the invention.

Referring now to FIG. 4, the various components illustrated schematically in FIGS. 1–3 are shown connected for purposes of air conditioning. A conduit 62 connects the high pressure side of the compressor 56 with the input side of the condenser 52. A conduit 64 is connected at one end to the output side of the condenser 52 and is connected at its other end to a capillary tube 66 which in turn is connected to the input side of the evaporator 42. A conduit 68 is tapped into the conduit 64 and is connected to another capillary tube 70 which in turn is connected to the input side of the evaporator 43. Thermostatically controlled, solenoid-actuated valves 72, 74 are disposed in the conduits 64, 68 immediately upstream of the capillary tubes 66, 70. The conduit 64 passes in heat exchange relationship through an accumulator 76. A filter/dryer 78 and a sight glass 80 also are disposed in the conduit 64.

Conduits 82, 84 are connected to the output side of the evaporators 42, 43, respectively. A common connecting conduit 86 establishes fluid communication between the conduits 82, 84 and the accumulator 76. A conduit 88 connects the accumulator 76 with the suction side of the compressor 56.

As will be apparent from an examination of FIG. 4, upon activation of the compressor 56, high pressure, high temperature fluid will be forced through the condenser 52 where it will be cooled by means of the fan 54. After passing through the accumulator 76, the filter/dryer 78, and the sight glass 80, and upon appropriate activation of either or both of the valves 72, 74, the fluid will be passed through the capillary tubes 66, 70 and then through the evaporators 42, 43. Air passing through the evaporators 42, 43 by virtue of activation of the fans 44 will be cooled, thereby cooling the room in which each of the evaporators 42 is disposed. After passing through the evaporators 42, 43, the fluid will be conveyed through the accumulator 76 where it will be returned to the compressor 56.

If the compressor 56 has two speeds, then the lower speed can be employed when only one of the evaporators 42, 43 is in use. If both of the evaporators 42, 43 are in use, then the higher speed of the compressor 56 can be utilized. If, however, a single-speed compressor is utilized, then a hot gas bypass must be provided for those instances where only one of the evaporators 42, 43 is being used. Such a bypass arrangement is indicated in FIG. 4 by the dotted lines 90, 92 which illustrate, respectively, a conduit connected between the conduit 62 and the conduit 82, and a conduit connected between the conduit 90 and the conduit 84. Theremostatically controlled bypass valves 94, 96 are disposed in the conduits 90, 92, respectively.

As will be appararent from an examination of FIG. 4, whenever predetermined temperature and/or pressure limits in the compressor 56 are exceeded, hot gas will be bypassed from the high pressure side of the condenser 52 to the return side of the evaporators 42, 43. The valves 94, 96 will be activated as appropriate to control the flow of hot fluid to the return side of the evaporator 42 or 43 being used.

The arrangement illustrated schematically in FIG. 4 provides an air conditioning capability only. If desired, electric strip heaters can be added to the evaporators 42, 43 to provide a heating capability. Additionally, if desired, the condenser 52 can be water cooled rather than air cooled. If a water cooling arrangement is provided, the fan 54 will be eliminated, but no other changes need to be made to the components of the system.

Figure 5:
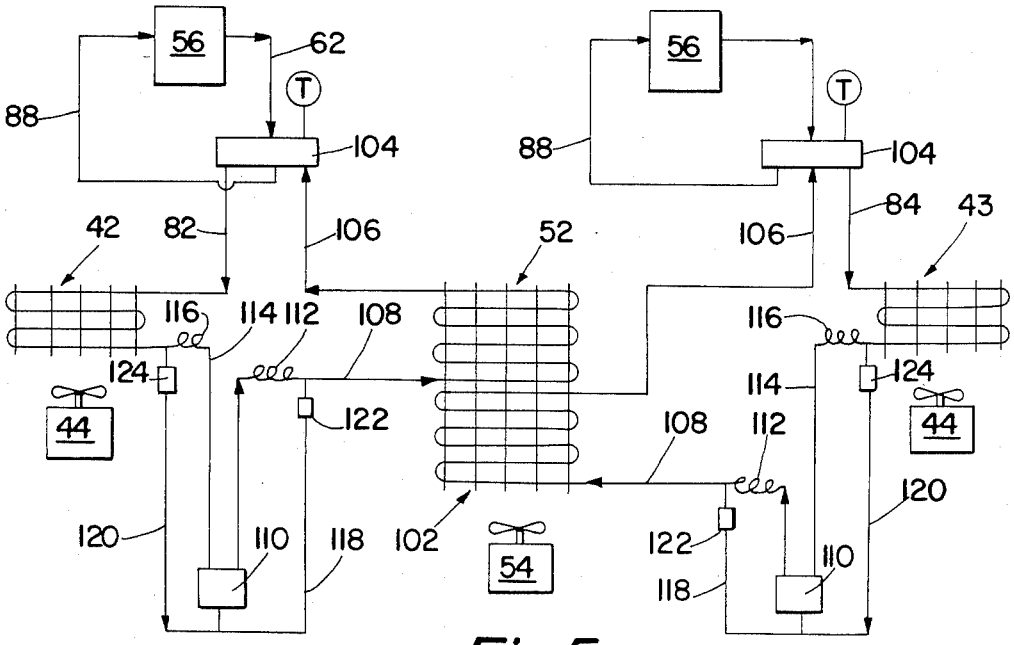
FIG. 5 is a piping diagram for an alternative embodiment of the invention.

Referring now to FIG. 5, an alternative embodiment of the invention is illustrated wherein both a heating and a cooling capability is provided by air conditioning apparatus operated as a heat pump. Where appropriate, reference numerals from the first-described embodiment will be used in the description of the alternative embodiment. As in the first embodiment, the evaporators 42, 43 and associated fans 44 are disposed in each of the rooms while the condenser 52 and its associated fan 54 are disposed outside of the rooms. Unlike the first-described embodiment, however, the alternative embodiment provides for fluid flow to be reversed through the evaporators 42, 43 depending upon whether the unit is in a cooling mode or a heating mode. Accordingly, the evaporators 42, 43 and condenser 52 will be referred to as "heat exchangers." An additional heat exchanger 102 also is provided, the additional heat exchanger 102 being disposed adjacent the heat exchanger 52 such that it can be cooled by the fan 54.

Each of the heating and cooling circuits is provided with a thermostatically controlled, solenoid-actuated changeover valve 104. The conduit 62 is connected to the input side of the valve 104. A conduit 106 connects each of the valves 104 to the heat exchangers 52, 102. The conduit 88 also is connected to the changeover valve 104 while the conduits 82, 84 are connected to the heat exchangers 42. The first and third heat exchangers 42, 52 are connected to each other by a parallel connection 107, as are the second and fourth heat exchangers 43, 102. The parallel connection 107 for the heat exchangers 42, 52 is provided by a conduit 108 which is connected at one end to the heat exchanger 52 and is connected at its other end to a filter/dryer 110. A capillary tube 112 is disposed in the conduit 108. Another conduit 114 is connected at one end to the heat exchanger 42 and is connected at the other end to the filter/dryer 110. Another capillary tube 116 is disposed in the conduit 114. A conduit 118 connects the filter/dryer 110 to the conduit 108 across the capillary tube 112. Similarly, a conduit 120 connects the filter/dryer 110 to the conduit 114 across the capillary tube 116. A check valve 122 is disposed in the conduit 118, while a check valve 124 is disposed in the conduit 120. The reference numerals for the parallel connection 107 are used for the same components that interconnect the heat exchangers 43, 102.

As will be apparent from an examination of FIG. 5, the apparatus is in a heat pump-type heating mode when the changeover valves 104 are in the position illustrated. High temperature, high pressure fluid will be directed through the conduits 82, 84 into the heat exchangers 42, 43 where it will release heat into the rooms. The fluid will pass through the check valves 124 and the conduits 120, through the filter/dryers 110, through the capillary tubes 112, the conduits 108, and into the heat exchangers 52, 102. Activation of the fan 54 will cause relatively warm atmosphere air to be directed over the heat exchangers 52, 102. Fluid thus heated will be drawn through the conduits 106, the valves 104, and the conduits 88 back into the suction side of the compressors 56.

Upon activation of the changeover valve 104, the flow of fluid through the components will be reversed and the apparatus will be in an air conditioning mode. Fluid now will be directed through the check valves 122, the conduits 118, the filter/dryers 110, the conduits 114, and the capillary tubes 116. It will be apparent that each of the valves 104 can be operated independently of the other so as to provide individual control of heating or air conditioning for each of the rooms being serviced.

As in the first-described embodiment, the heat exchangers 52, 102 can be water cooled, if desired. Additionally, because the two heat exchangers 52, 102 are disposed adjacent each other, it is desirable to provide either a pressure-controlled variable speed fan 54 or a preprogrammed two-speed fan 54. The lower speed can be selected when only one of the heat exchangers 52, 102 is in operation, while the higher speed can be selected when both of the heat exchangers 52, 102 are in operation.

AN ALTERNATIVE EMBODIMENT

Figure 8:
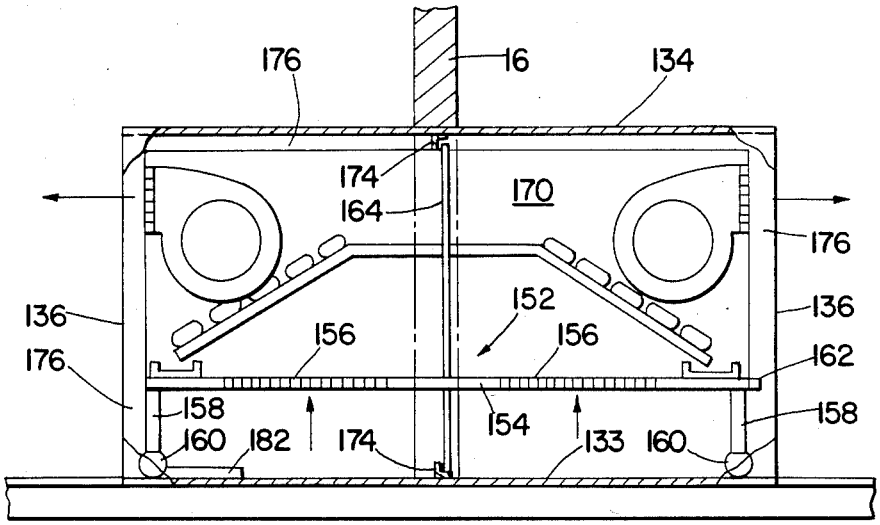
FIG. 8 is a schematic end view of the unit of FIG. 6.

Referring to FIGS. 6–8, an alternative embodiment of air conditioning apparatus according to the invention is indicated generally by the reference numeral 130. Many of the components of the apparatus 130 are the same as those described previously and, where appropriate, the same reference numerals will be used.

The apparatus 130 includes a cubic housing 132 within which certain components of the invention are disposed. Like the previously described housing 12, the housing 132 extends through an opening formed in an exterior wall 14 of the building, and the housing 132 straddles an opening formed in a common interior wall 16 dividing two adjacent rooms. Unlike the housing 12, however, the housing 132 extends completely to the floor 133, and the other components of the apparatus 130 are completely contained within the housing 132 during use.

The housing 132 includes a top wall 134, side walls 136, and an end wall 138. The walls 134, 136, 138 are connected to each other at right angles by means of easily removable fasteners such as screws. The fasteners preferably are tamper-proof in order to prevent unauthorized access to the interior of the housing 132. Because the side walls 136 and the end wall 138 extend completely to the floor 133, louvered openings 140, 142 are provided in the walls 136, 138, respectively, adjacent the lower portions thereof in order to permit air to be drawn into the housing 132. The side walls 136 also include louvered openings 144 which enable cooled or heated air to be discharged back into the room. A control panel 146 also is disposed on each of the side walls 136, one control panel 146 being provided for each room. As with the housing 12, the housing 132 is of a size and shape that enables the housing 132 to be utilized as a desk or as a support for such items as lamps, televisions, radios, books, and the like.

The exterior wall 14 includes an opening 148 closed by a louvered panel 150. The louvered panel 150, in effect, forms a continuation of the wall 14. As can be seen in FIG. 7, the side walls 136 (as well as the top wall 134) extend into the opening 148. An appropriate seal is formed by means of a gasket (not shown) or by directly securing the walls 134, 136 to the sides of the opening 148 in order to establish a substantially airtight connection between the housing 132 and the wall 14.

The various components of the invention such as the evaporators 42, 43, the condenser 52, the fan 54, the compressor 56, and so forth are placed atop a cart 152 which is adapted to be wheeled into and out of the housing 132 so as to facilitate installation and servicing. The cart 152 includes a floor 154 having openings 156. Legs 158 having wheels, or casters 160, are positioned at the corners of the floor 154 so as to space the floor 154 above the floor 133 of the room and to enable air to be freely drawn into the housing 132 and upwardly through the openings 156. A handle 162 is secured along one edge of the floor 154 in order to assist the user in moving the cart 152 from place to place.

A vertically extending panel or wall 164 is disposed toward the center of the cart 152. The wall 164 extends upwardly from the floor 154 almost to the underside of the top wall 134, and downwardly from the floor 154 almost to the floor 133 of the room. The wall 164 is aligned with the longitudinal axis of the cart 152 such that, in use, the wall 164 is coincident with the wall 16 and divides the housing 132 into two compartments 166, 168 corresponding to the compartments 28, 30 of the housing 12. A vertically extending panel or wall 170 is positioned at right angles to the wall 164 and, like the wall 164, extends upwardly from the floor 154 to a location adjacent the underside of the top wall 134, and downwardly from the floor 154 to a location adjacent the floor 133 of the room. As can be seen in FIG. 7, the wall 170 creates a compartment 172 adjacent the louvered panel 150 comparable to the third compartment 34 in the previously described embodiment.

It is necessary that the compartments 166, 168, 172 be separated from each other by means of good acoustic and fluidic seals. To that end, an angled member 174 (FIG. 7A) is secured to the underside of the top wall 134, to the inside of the end wall 138, and to the floor of the room. As best seen in FIG. 6, the member 174 is U-shaped and is disposed within the housing 132 such that it is coincident with the interior wall 16. In like manner, an angled member 176 is secured to the inner surfaces of the housing 132 and is disposed parallel to the wall 14. A gasket material 178 in the form of a cellular foam or a similar material is secured to the members 174, 176. The gaskets 178 are positioned on that face of the members 174, 176 that come into contact with the walls 164, 170.

A panel insert 180 is provided to be inserted into the housing 132 after the cart 152 has been placed in its operating position within the housing 132. The panel 180 is generally rectangular and, as shown in FIG. 6, is adapted to be held in place by removable fasteners at the closed end of the U-shaped member 174.

In order to assist the installer in moving the cart 152 into the correct installed position where good seals are attained, a guide means in the form of L-shaped tracks 182 can be provided. The tracks 182 establish runways for the wheels 160. The tracks 182 are secured to the floor 133 in the compartment 166 in suitable locations such that the cart 152 can be moved to its correct installed position without any particular effort being required by the installer.

OPERATION OF THE ALTERNATIVE EMBODIMENT

Figure 9A:
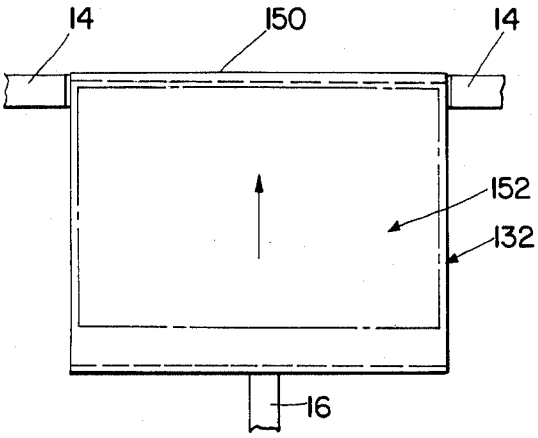
FIGS. 9A, 9B, and 9C are schematic plan views of the unit of FIG. 6 showing how the unit can be removed and replaced.
Figure 9B:
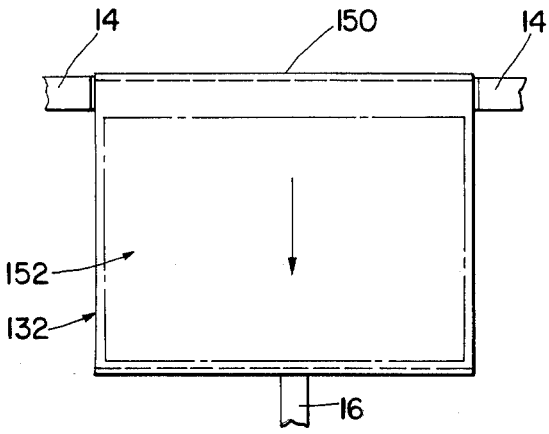
Figure 9C:
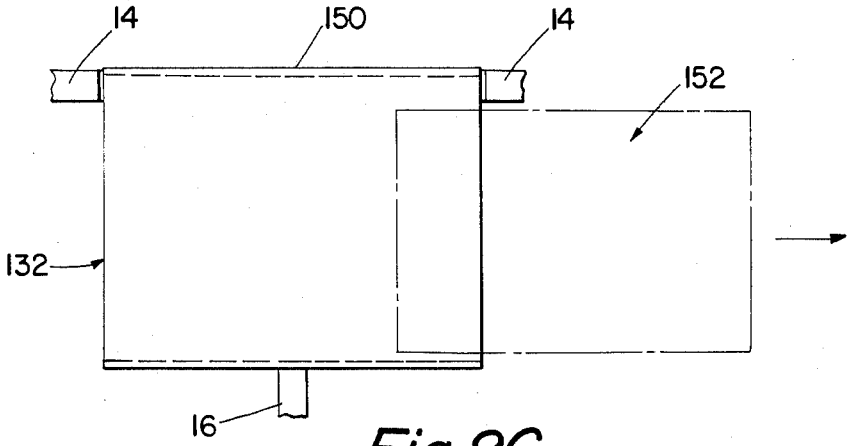

Referring particularly to FIGS. 9A–9C, operation of the alternative embodiment 130 is illustrated schematically. In particular, the following steps are carried out:

1. In order to remove the apparatus 130 for repair or replacement, the side wall 136 which forms one wall of the compartment 168 is removed.
2. The control panel 146 associated with the removed side wall 136 itself is removed, or is disconnected by means of a plug-in connection (not shown) from the electrical components employed with the apparatus 130.
3. The panel 180 is removed.
4. The cart 152 is moved to the rear of the housing 132 as indicated in FIG. 9B.
5. The cart 152 is pulled sideways from the housing 132 as indicated in FIG. 9C.
6. After the defective components have been repaired, or after new apparatus 130 has been installed on the cart 152, the apparatus 130 can be installed by reversing the previously described steps.

It will be appreciated that the particular construction of the housing 132, particularly the mobile nature of the cart 152, makes it exceedingly easy for the apparatus 130 to be installed. It is anticipated that users may wish to keep one or more operational units 130 in reserve so that they can be quickly placed into service in the event that an already-installed unit 130 needs to be repaired. Also, because the casters 160 enable the cart 152 to be moved easily from place to place, difficulties usually associated with replacing air conditioning apparatus are alleviated greatly.

Although the invention has been described in its preferred form with a certain degree of particularlity, it will be apparent that various changes and modifications can be made without departing from the true spirit and scope of the invention as hereinafter claimed. It is expected that the patent cover all such changes and modifications. It also is intended that the patent shall cover, by suitable expression in the appended claims, whatever features of patentable novelty exist in the invention disclosed.

What is claimed is:

1. Apparatus for connecting an air conditioner to an exterior wall of a structure such as a hotel, motel, hospital, or the like, the wall having an opening that extends into two adjacent rooms, the two adjacent rooms being divided by an interior wall having a cutout section disposed adjacent the opening in the exterior wall, the apparatus comprising:

a housing connected to the exterior wall and disposed about the opening, the housing being fitted into the cutout section of the interior wall;

a cart atop which the air conditioner is disposed, the cart having wheels and being of a size and shape to enable the air conditioner and the cart to be wheeled into the housing such that the air conditioner can be moved into an installed position within the housing;

first barrier means disposed generally parallel to the exterior wall for creating a first compartment within the housing, the first compartment being exposed to the atmosphere through the opening in the exterior wall; and second barrier means disposed generally parallel to the interior wall and connected to the first barrier means, the second barrier means creating second and third compartments within the housing, the second compartment being disposed in one room on one side of the interior wall, and the third compartment being disposed in the adjacent room on the other side of the interior wall; and the air conditioner includes a condenser and two evaporators, the condenser being disposed within the first compartment, one of the evaporators being disposed within the second compartment, and the other evaporator being disposed within the third compartment.

2. The apparatus of claim 1 wherein the first and second barrier means are in the form of panels carried by the cart.

3. The apparatus of claim 1, further comprising sealing members disposed within the housng, the sealing members being engaged by the first and second barrier means when the air conditioner is in its installed position.

4. The apparatus of claim 1, further comprising guide means disposed within the housing for directing the air conditioner directly into its installed position within the housing.

5. The apparatus of claim 4, wherein the guide means is in the form of tracks secured to the floor within the housing, the tracks forming runways upon which selected wheels of the cart can be moved.

* * * * *